US005845524A

United States Patent [19]

Koehler

[11] Patent Number: 5,845,524

[45] Date of Patent: Dec. 8, 1998

[54] LOCK ASSEMBLY

[76] Inventor: Joseph E. Koehler, 14 Christopher La., Scituate, Mass. 02066

[21] Appl. No.: 859,482

[22] Filed: May 20, 1997

Related U.S. Application Data

[60] Provisional application No. 60/018,029, May 21, 1996.

[51] Int. Cl.[6] ..... E05B 49/04

[52] U.S. Cl. ..... 70/278; 292/144; 70/78

[58] Field of Search ..... 70/277, 278, 283, 70/78, 79, 80, 81–86; 292/201, 144, DIG. 37, 139, 196

[56] References Cited

U.S. PATENT DOCUMENTS

| | | | |
|---|---|---|---|
| 3,069,193 | 12/1962 | Kirk | 292/144 |
| 4,634,155 | 1/1987 | Geringer et al. | 292/144 |
| 5,257,860 | 11/1993 | Slivon | 70/78 |
| 5,385,039 | 1/1995 | Feldpausch et al. | 70/278 |
| 5,389,919 | 2/1995 | Warren et al. | 70/278 |
| 5,507,161 | 4/1996 | Brogkaert et al. | 70/69 |

FOREIGN PATENT DOCUMENTS

| | | | |
|---|---|---|---|
| 2163579 | 2/1986 | United Kingdom | 70/278 |

*Primary Examiner*—Darnell M. Boucher
*Attorney, Agent, or Firm*—Pandiscio & Pandiscio

[57] ABSTRACT

A lock assembly comprises a plunger reciprocally mounted in a support means, a spring for biasing the plunger in an unlock direction and for holding the plunger in an unlock position, the plunger being movable against the spring bias into a lock position, and link members for holding the plunger in the lock position. The assembly further includes a solenoid having a shaft adapted to operate the link members to release the plunger from the lock position to permit the plunger to be moved by the spring to the unlock position, and an entry console in electrical communication with the solenoid and operable to send an unlock signal to the solenoid upon entry of a selected entry signal.

5 Claims, 5 Drawing Sheets

LOCK ASSEMBLY

CROSS-REFERENCE TO RELATED APPLICATION

This application claims the benefit of U.S. Provisional application Ser. No. 60/018,029, filed May 21, 1996, in the name of Joseph E. Koehler.

BACKGROUND OF THE INVENTION (1). Field of the Invention

The invention relates to locking devices and is directed more particularly to a lock assembly suitable for file cabinets, and the like.

(2). Description of the Prior Art

In a well-known file cabinet lock assembly, a plunger extends forwardly from a face of the file cabinet. To lock the cabinet, an operator pushes the plunger inwardly of the cabinet, which causes mechanical activation of locking arms in the file cabinet frame, the arms moving to enter slots in the drawer structures to lock the drawers in the closed position. Simultaneously, a catch means engages the plunger to keep the plunger in the pushed-in position. The plunger is provided with a key hole in a cylinder extending generally axially of the plunger. To unlock the file cabinet, an operator inserts a key into the key hole and turns the key, to cause turning of the cylinder, which causes the catch means to release the plunger which, under spring bias, moves forwardly, i.e., in a direction outwardly from the face of the cabinet. The forward movement of the plunger causes the locking arms to disengage from the slots in the drawers, releasing the drawers for movement to open positions.

In use of the above-described lock assembly, the safe keeping of keys and prevention of duplication of keys constitute repetitive problems. In large office environments, the intermingling of large numbers of keys leads to delays in matching keys and locks.

There exists a need for a keyless lock assembly which is adapted for quick and easy unlocking of one or more cabinets, or other storage housings, upon entering of a combination in a push-button console, or other entry signal in an appropriate entry console, and which locks in the time-honored fashion. There further exists a need for a lock assembly which can be adapted to provide a user identification retention means, and which can be adapted for simultaneous unlocking of a plurality of housings.

SUMMARY OF THE INVENTION

Accordingly, an object of the invention is to provide a keyless lock assembly which is operable, by entering a combination, or other entry signal, for quick and easy unlocking.

A further object of the invention is to provide such a lock assembly for a storage housing wherein the locking thereof is effected by pushing a plunger into the housing.

A still further object of the invention is to provide such a lock assembly which can be adapted for user identification retention and which can be adapted for simultaneous unlocking of a plurality of housings.

With the above and other objects in view, as will hereinafter appear, a feature of the present invention is the provision of a lock assembly comprising a plunger reciprocally mounted in a support means, spring means for biasing the plunger in an unlock direction and for holding the plunger in an unlock position, the plunger being movable against the spring means into a lock position, and link means for holding the plunger in said lock position. The assembly further includes a solenoid having a shaft adapted to operate the link means to release the plunger from the lock position to permit the plunger to be moved by the spring means to the unlock position, and an entry console in electrical communication with the solenoid and operable to send an unlock signal to the solenoid upon entry of a selected entry signal.

In accordance with a further feature of the invention, there is provided a lock assembly comprising a plunger reciprocally mounted in support means and spring-biased in a first axial direction, a moving link pivotally mounted on the plunger, the moving link having an arm portion and a link portion, the arm portion having at a free end thereof a slot and a pin, the link portion at a first end thereof being fixed to the arm portion and at a second end thereof being pivotally connected to an anchor link which is pivotally mounted on an anchor bracket. The assembly further includes a leaf spring fixed at a first end to the anchor bracket and having at a free end thereof a raised portion with an aperture therein adapted to receive the arm pin. The assembly further includes a solenoid having a reciprocal shaft therein, the shaft extending through the arm slot and having a flange at a distal end thereof engageable with the leaf spring raised portion. The solenoid is in communication with an entry console operable to cause the solenoid to draw the solenoid shaft into the solenoid against spring bias, with the solenoid shaft flange being engageable with the leaf spring raised portion to bend the leaf spring to move the leaf spring clear of the arm pin, to release the arm and thereby the plunger, permitting the spring-biased plunger to move in the first axial direction for an unlocking operation.

In accordance with a further feature of the invention, there is provided a lock assembly as described immediately above, wherein the plunger is moveable in the support means in a second axial direction against the spring bias, and wherein the moving link pivotal mounting and the anchor link pivotal mounting cause the moving link free end to move such that the arm portion slot passes around the solenoid shaft and the arm portion pin engages the leaf spring raised portion and enters the leaf spring aperture to retain the plunger in a locking position.

In accordance with a still further feature of the invention, there is provided a lock assembly as described immediately above wherein the solenoid shaft is spring-biased in a direction toward the distal end thereof.

In accordance with a still further feature of the invention, there is provided a plurality of lock assemblies, each as described above, each in electrical communication with the aforesaid entry console, such that operation of the console serves to unlock the plurality of the lock assemblies simultaneously.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
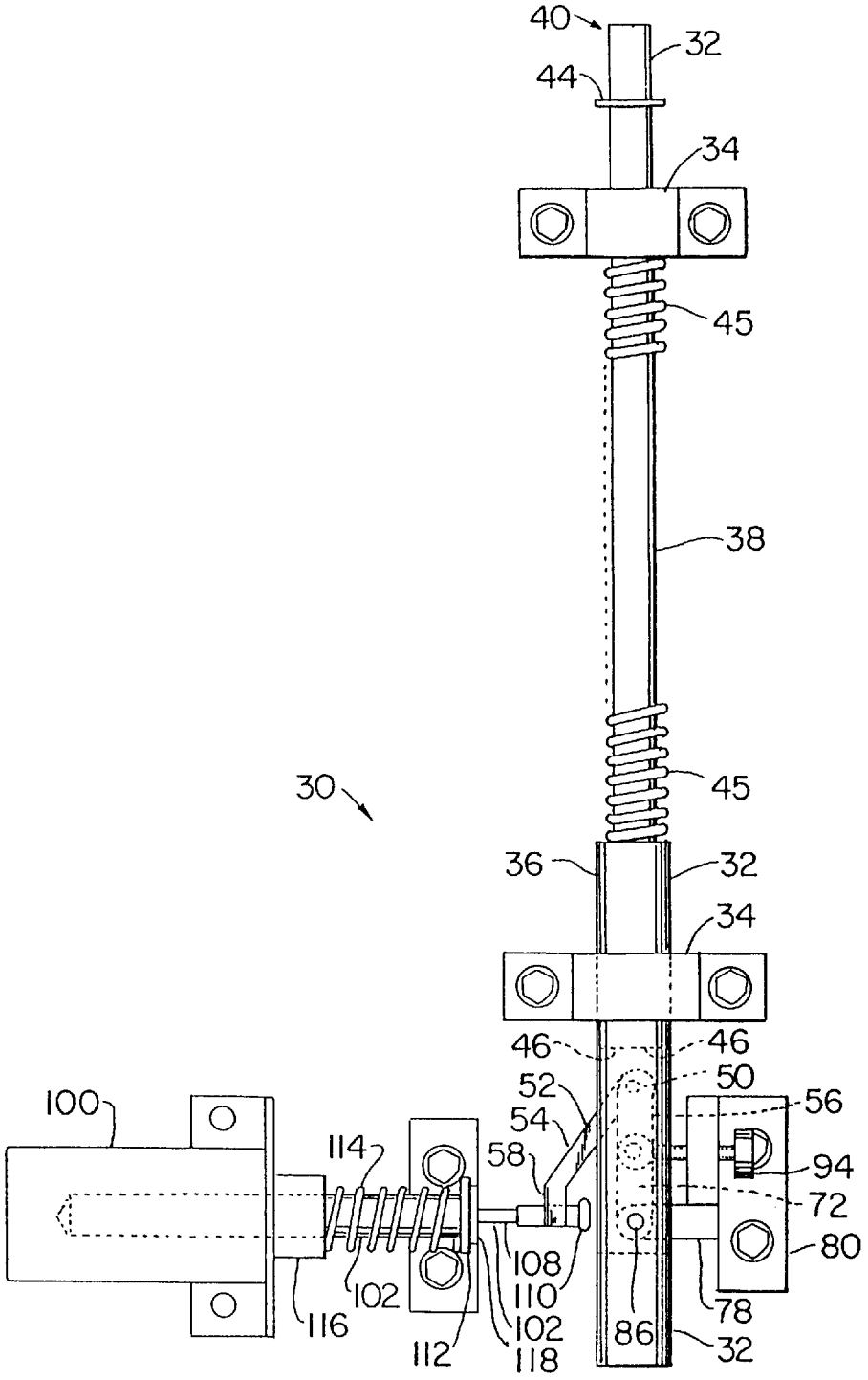
FIG. 1 is a top plan view of one form of a lock assembly illustrative of an embodiment of the invention.
Figure 3:
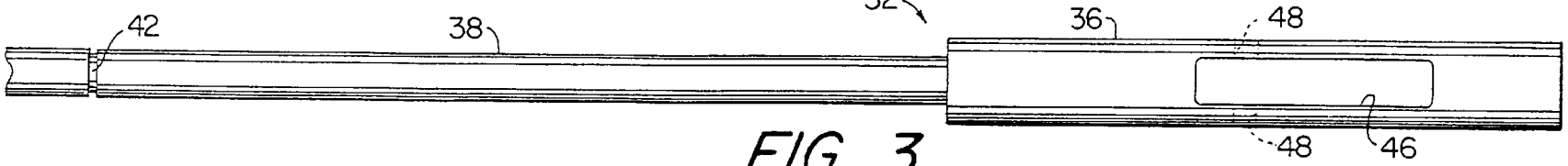
FIG. 3 is a side elevational view of a plunger member of the assembly of FIG. 1.
Figure 4:
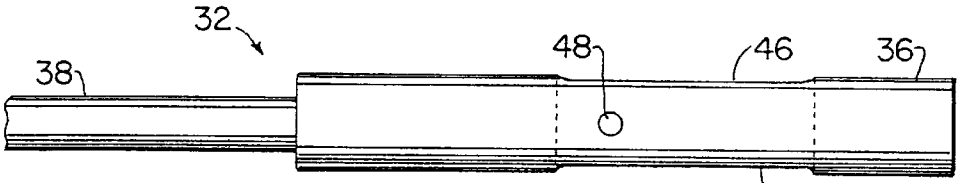
FIG. 4 is a top plan view of a portion of the plunger member of FIG. 3.
Figure 5:
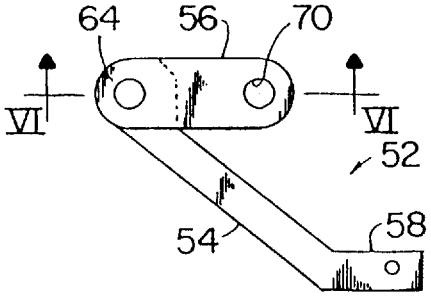
FIG. 5 is a top plan view of a moving link member of the assembly of FIG. 1.

Referring to FIG. 1, it will be seen that an illustrative lock assembly 30 includes a plunger 32 slidably mounted in support members 34. The plunger 32 includes a first portion 36 (FIGS. 3 and 4) and a second portion 38 of smaller diameter than the first portion 36. The plunger second portion 38 is provided, proximate an end 40 thereof (FIG. 3), with an annular groove 42 in which is mounted a retaining ring 44 (FIG. 1). A coil spring 45 is mounted on the plunger second portion 38, between the plunger first portion 36 and the rearward-most support member 34. The spring 45 urges the plunger 32 forwardly into an unlock position.

The plunger first portion 36 is provided with a slot 46 therethrough. Intersecting the slot 46 is a bore 48 (FIGS. 3 and 4) in which is disposed a pivot pin 50 (FIG. 1). Disposed in the slot 46 and pivotally mounted on the pin 50, is a moving link 52 (FIGS. 1, 5–9) having an arm portion 54 and a link portion 56.

Figure 7:
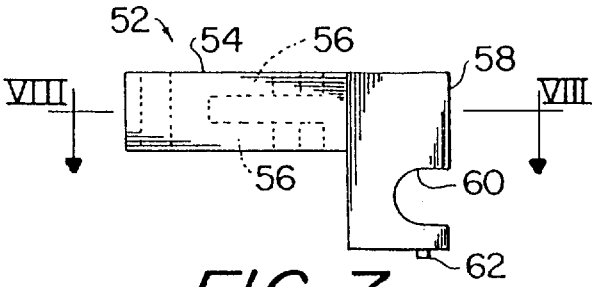
FIG. 7 is a side elevational view of the moving link member of FIG. 5.
Figure 8:
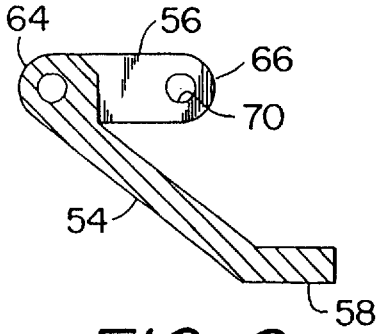
FIG. 8 is a sectional view taken along line VIII—VIII of FIG. 7.
Figure 9:
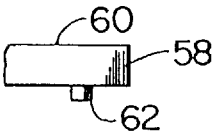
FIG. 9 is an enlarged view of a portion of the moving link member of FIG. 7.

The moving link arm portion 54 includes an enlarged end portion 58 having therein an open-ended slot 60 (FIG. 7) and having extending therefrom a pin 62 (FIGS. 7 and 9).

Figure 6:
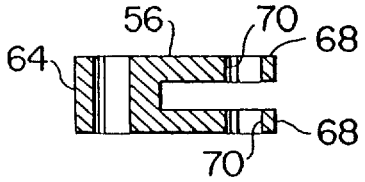
FIG. 6 is a sectional view of a link portion of the moving link member of FIG. 5, taken along line VI—VI of FIG. 5.

The moving link portion 56, at a first end 64 thereof (FIGS. 5 and 8), is fixed to the arm portion 54 and is pivotally movable with the arm portion 54 on the pivot pin 50. As shown in FIG. 6, the link portion 56 is bifurcated and a second end 66 thereof includes legs 68 having aligned bores 70 therethrough.

Figure 10:
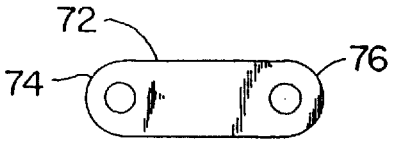
FIG. 10 is a top plan view of an anchor link member of the assembly of FIG. 1.
Figure 11:
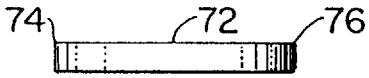
FIG. 11 is a side elevational view of the anchor link member of FIG. 10.

Disposed between the legs 68 of link portion 56 is an anchor link 72 (FIGS. 10 and 11) pivotally connected at a first end 74 thereof to the legs 68 of link portion 56 and pivotally connected at a second end 76 thereof to an arm 78 of an anchor bracket 80. The arm 78 of the anchor bracket 80 is bifurcated to form an open-ended slot 82 in which is disposed the anchor link second end 76 and is provided with bores 84 for receiving a pin 86 (FIG. 1) about which the anchor link 72 and link portion second end 66 pivot.

Figure 2:
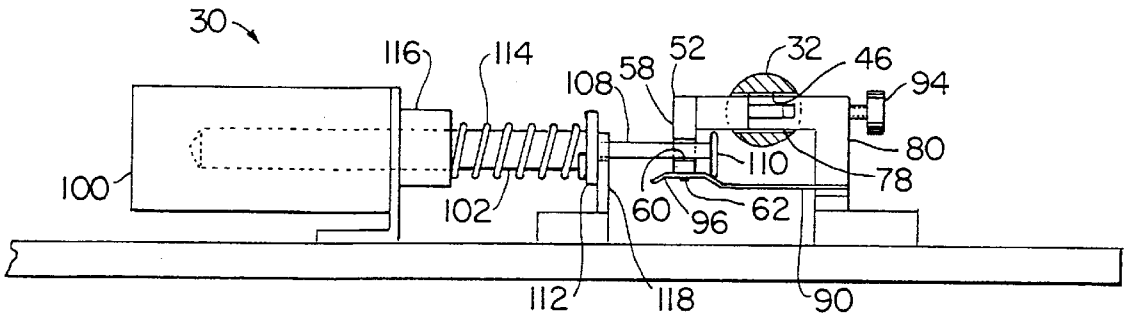
FIG. 2 is a front elevational view of the lock assembly of FIG. 1.
Figure 12:
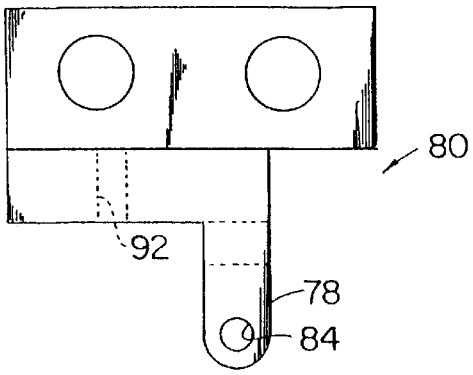
FIG. 12 is a top plan view of an anchor bracket member of the assembly of FIG. 1.
Figure 13:
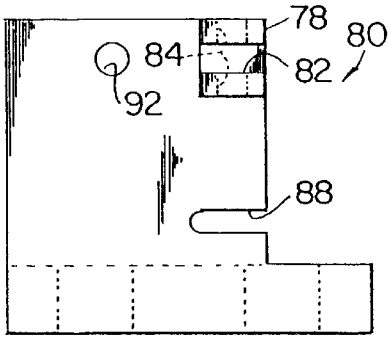
FIG. 13 is a side elevational view of the anchor bracket member of FIG. 12.
Figure 14:
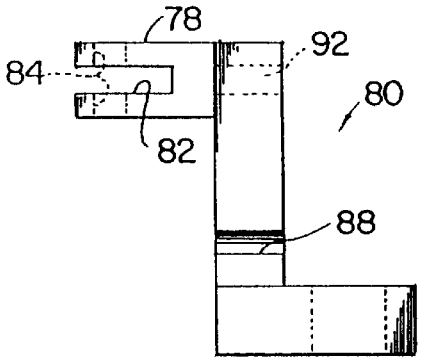
FIG. 14 is a front elevational view of the anchor bracket member of FIG. 12.
Figure 15:
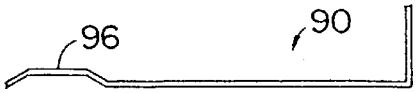
FIG. 15 is a front elevational view of a leaf spring member of the assembly of FIG. 1.
Figure 16:
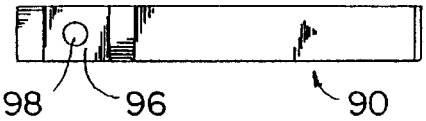
FIG. 16 is a top elevational view of the leaf spring member of FIG. 15.

The anchor bracket 80 is further provided with an open-ended slot 88 (FIGS. 13 and 14) in which is fixed one end of a leaf spring 90 (FIGS. 2, 15 and 16). The anchor bracket 80 is still further provided with a threaded hole 92 (FIGS. 12–14) for receiving a stabilizing screw 94 (FIGS. 1 and 2).

Referring to FIGS. 2, 15 and 16, it will be seen that the leaf spring 90 includes a raised portion 96 having an aperture 98 therein, the aperture 98 being adopted to receive the moving link arm portion pin 62.

Figure 17:
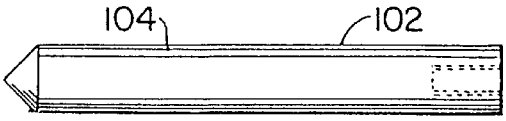
FIG. 17 is a front elevational view of a first portion of a solenoid shaft portion of the assembly of FIG. 1.
Figure 18:
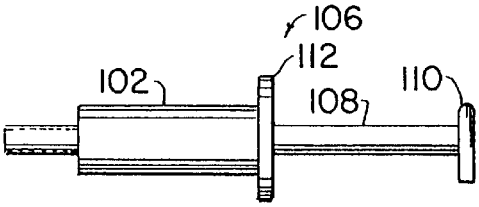
FIG. 18 is a front elevational view of a second portion of the solenoid shaft portion of the assembly of FIG. 1.
Figure 19:
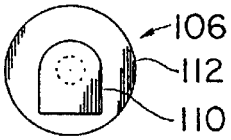
FIG. 19 is a side elevational view of the second portion of the solenoid shaft portion of FIG. 18.

The lock assembly 30 further includes a solenoid 100 having extending therefrom a reciprocally movable shaft 102 (FIGS. 1 and 2). Referring to FIGS. 17 and 18, it will be seen that the shaft 102 includes a base shaft portion 104 threadedly attached to a shaft adapter portion 106 which includes a stem portion 108. To a distal end of the stem portion 108 of the shaft 102 is fixed an abutment plate 110. The shaft adaptor portion 106 includes a circular flange 112. Referring again to FIGS. 1 and 2, it will be seen that a coil spring 114 is mounted on the shaft 102 between the flange 112 and a collar 116 mounted on the solenoid 100. The coil spring 114 urges the shaft 102 in a direction toward its distal end, i.e., toward the anchor bracket 80. Engagement of the flange 112 with a bracket and stop member 118 limits such movement of the shaft 102.

Figure 20:
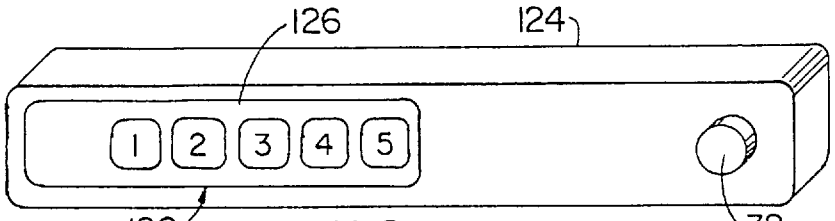
FIG. 20 is a perspective view of an entry console and housing for the assembly of FIG. 1.
Figure 21:
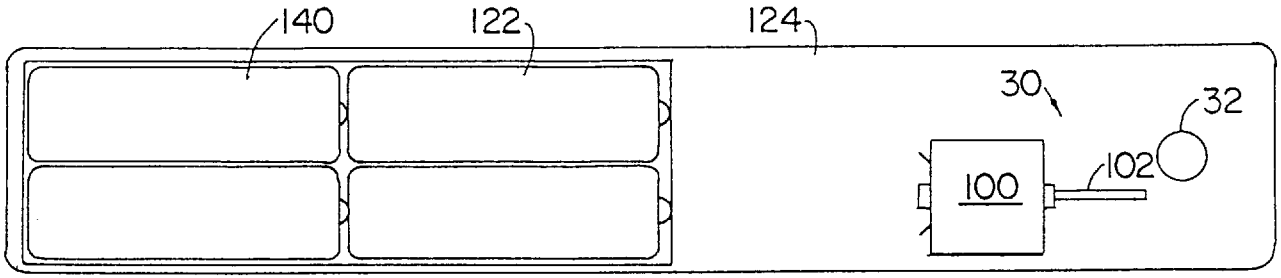
FIG. 21 is a diagrammatic front elevational illustration of the console and housing of FIG. 20, with a front wall removed.
Figure 22:
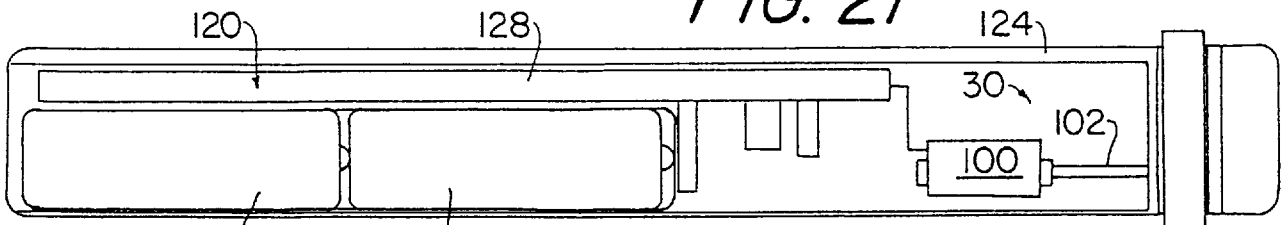
FIG. 22 is a diagrammatic top plan illustration of the console and housing of FIG. 20, with a top wall removed.

Referring to FIGS. 20–22, it will be seen that the lock assembly 30 and entry console 120, with power source 122, are disposed in a housing 124. The entry console 120 may include a push button pad 126 and appropriate electronics 128. The housing 124 typically is mounted on the front of a cabinet, or other protected storage housing (not shown). The plunger 32 is operative to move linkages and levers (not shown) to effect locking and unlocking of drawers, or doors, as is well known in the art and in current use on a wide scale. The power source 122 may be batteries 140, as shown in FIGS. 21 and 22, or may be electrical wiring in communication with a remote power source (not shown). The electronics 128 may operate the single solenoid 100 to unlock a single storage housing or may be adapted to operate a plurality of solenoids 100 simultaneously, such that operation of a single entry console is effective to unlock a plurality of storage housings.

In operation, to move the plunger 32 from the lock position, shown in FIG. 1, to an unlock position, an operator enters a combination by use of the push button pad 126 of the entry console 120. A correct combination energizes the solenoid 100 which draws the shaft 102 into the solenoid 100, or leftwardly as viewed in FIGS. 1 and 2. Such leftward movement of the shaft 102 causes leftward movement of the shaft stem portion 108 through the slot 60 in the arm end portion 58, and leftward movement of the abutment plate 110. Engagement of the abutment plate 110 with the raised portion 96 operates to deflect the leaf spring 90 downwardly, as viewed in FIG. 2, to disengage the leaf spring aperture 98 from the pin 62. Release of the pin 62 enables the coil spring 45 to push the plunger 32 forwardly to an unlock position.

To return the assembly 30 to the lock position, the operator merely pushes the plunger rearwardly, or into the housing 124, which causes the anchor link 72 and moving link arm portion 54 to move the link portion 56 such that the arm end portion 58 moves back around the solenoid shaft stem portion 108 and the end portion pin 62 re-engages the aperture 98 in the leaf spring 90. Meanwhile, the solenoid coil spring 114 has moved the abutment plate 110 back to the position shown in FIG. 2, abutting the raised portion 96 of the leaf spring 90. The assembly 30 is then in the lock position and remains so until an appropriate operation of the entry console 120.

It is to be understood that the present invention is by no means limited to the particular construction herein disclosed and/or shown in the drawings, but also comprises any modifications or equivalents within the scope of the claims. For example, the entry console 120 need not necessarily be a numerical-based combination type, but may be triggered by any similar means, such as voice activation, identification card entry, finger print entry, and the like. Whether the entry console is based upon a numerical code or other type entry, the electronics 128 may include a memory which retains the identification of the operator unlocking the assembly 30 and any other desired data, such as date and time of unlocking.

What is claimed is:

1. A lock assembly comprising:

a plunger reciprocally mounted in support means and spring-biased in a first axial direction;

a moving link pivotally mounted on said plunger, said moving link having an arm portion and a link portion;

the arm portion having at a free end thereof a slot and a pin;

the link portion at a first and thereof being fixed to said arm portion and at a second end thereof being pivotally connected to an anchor link which is pivotally mounted on an anchor bracket;

a leaf spring fixed at a first end to said anchor bracket and having at a free end thereof a raised portion with an aperture therein adapted to receive said arm pin;

a solenoid having a reciprocal shaft therein, said shaft extending through said arm slot and having a flange at a distal end thereof engageable with said leaf spring raised portion; and an entry console in communication with said solenoid and operable to cause said solenoid to draw said solenoid shaft into said solenoid, with said solenoid shaft flange engageable with said leaf spring raised portion to bend said leaf spring to move said leaf spring clear of said arm pin, to release said arm portion and thereby said plunger, permitting said spring-biased plunger to move in said first axial direction for an unlocking operation.

2. The lock assembly in accordance with claim 1, wherein said plunger is moveable in said support means in a second axial direction against said spring bias, and wherein said moving link pivotal mounting and said anchor link pivotal mounting causes said moving link free end to move such that said arm portion slot passes around said solenoid shaft and said arm portion pin engages said leaf spring raised portion and enters said leaf spring aperture to retain said plunger in a locking position.

3. The lock assembly in accordance with claim 2, wherein said solenoid shaft is spring-biased in a direction toward a distal end thereof.

4. The lock assembly in accordance with claim 1 in combination with at least one other such lock assembly, wherein said entry console is in electrical communication with, and operable to activate, said lock assembly and said other lock assembly simultaneously.

5. The lock assembly in accordance with claim 1 wherein said entry console is a numerical combination activated console.

* * * * *